US007850546B2

(12) United States Patent
Chao et al.

(10) Patent No.: US 7,850,546 B2
(45) **Date of Patent: *Dec. 14, 2010**

(54) GOLF CLUB HEAD HAVING A COMPOSITE FACE INSERT

(75) Inventors: Bing-Ling Chao, San Diego, CA (US); Todd P. Beach, San Diego, CA (US); Jabaarr A. Flukers, Vista, CA (US); Citra A. Ie, San Diego, CA (US); Benoit Vincent, Leucadia, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/589,484

(22) Filed: Oct. 22, 2009

(65) Prior Publication Data

US 2010/0099513 A1 Apr. 22, 2010

Related U.S. Application Data

(60) Division of application No. 11/895,195, filed on Aug. 21, 2007, now Pat. No. 7,628,712, which is a continuation of application No. 10/442,348, filed on May 21, 2003, now Pat. No. 7,267,620.

(51) Int. Cl.
*A63B 53/04* (2006.01)

(52) U.S. Cl. ..... 473/342; 473/345; 473/348

(58) Field of Classification Search ..... 473/324–350
See application file for complete search history.

(56) References Cited

U.S. PATENT DOCUMENTS 1,133,129 A 3/1915 Govan (Continued)

FOREIGN PATENT DOCUMENTS

GB 1 201 648 8/1970

(Continued)

OTHER PUBLICATIONS

English Translation of the Appeal Board's Questioning, Japanese Application No. 2004-150575, Appeal No. 2008-15208, 4pp. (Nov. 20, 2009).

(Continued)

*Primary Examiner*—Alvin A Hunter
(74) *Attorney, Agent, or Firm*—Klarquist Sparkman, LLP

(57) ABSTRACT

A golf club head having a composite face insert attached to a metallic body is provided. The club head preferably has a volume of at least 200 cc and provides superior durability and club performance. The face insert includes prepreg plies having a fiber areal weight (FAW) of less than 100 g/m$^2$. The face insert preferably has a thickness less than 4 mm and a mass at least 10 grams less than an insert of equivalent volume formed of the metallic material of the body of the club head. A metallic cap with a peripheral rim is also provided to protect the ends of the composite material of the face insert. Related methods of manufacturing and alternative materials are disclosed. The resin content of the prepreg plies can be controlled through management of the timing and environment in which the resultant prepreg plies are cured and soaked.

5 Claims, 5 Drawing Sheets

U.S. PATENT DOCUMENTS 3,567,228 A 3/1971 Lynn
3,695,618 A 10/1972 Woolley et al.
3,836,153 A 9/1974 Dance, Jr.
3,937,474 A 2/1976 Jepson et al.
4,398,965 A 8/1983 Campau
4,523,759 A 6/1985 Igarashi
4,539,253 A 9/1985 Hirschbuehler et al.
4,545,580 A 10/1985 Tomita et al.
4,618,149 A 10/1986 Maxel
4,740,345 A 4/1988 Nagasaki et al.
4,792,139 A 12/1988 Nagasaki et al.
4,793,616 A 12/1988 Fernandez
4,798,383 A 1/1989 Nagasaki et al.
4,804,188 A 2/1989 McKee et al.
4,809,978 A 3/1989 Yamaguchi et al.
4,848,747 A 7/1989 Fujimura et al.
4,884,812 A 12/1989 Nagasaki et al.
4,928,972 A 5/1990 Nakanishi et al.
4,964,640 A 10/1990 Nakanishi et al.
4,995,609 A 2/1991 Parente et al.
5,007,643 A 4/1991 Okumoto et al.
5,016,882 A 5/1991 Fujimura et al.
5,078,397 A 1/1992 Aizawa
5,106,094 A 4/1992 Desbiolles et al.
5,135,227 A 8/1992 Okumoto et al.
5,176,384 A 1/1993 Sata et al.
5,261,664 A 11/1993 Anderson
5,271,621 A 12/1993 Lo
5,277,423 A 1/1994 Artus
5,310,185 A 5/1994 Viollaz et al.
5,312,106 A 5/1994 Cook
5,344,140 A 9/1994 Anderson
5,346,216 A 9/1994 Aizawa
5,348,302 A 9/1994 Sasamoto et al.
5,377,986 A 1/1995 Viollaz et al.
5,417,419 A 5/1995 Anderson et al.
5,425,538 A 6/1995 Vincent et al.
5,433,440 A 7/1995 Lin
5,465,969 A 11/1995 Cadorniga
5,472,201 A 12/1995 Aizawa et al.
5,480,153 A 1/1996 Igarashi
5,494,281 A 2/1996 Chen
5,499,819 A 3/1996 Nagamoto
5,505,453 A 4/1996 Mack
5,518,242 A 5/1996 Mahaffey et al.
5,529,543 A 6/1996 Beaumont, Sr.
5,672,120 A 9/1997 Ramirez et al.
5,697,855 A 12/1997 Aizawa
5,720,673 A 2/1998 Anderson
5,743,813 A 4/1998 Chen et al.
5,774,970 A 7/1998 Huang
5,827,131 A 10/1998 Mahaffey et al.
5,830,084 A 11/1998 Kosmatka
5,906,550 A 5/1999 Kingston
5,967,903 A 10/1999 Cheng
5,985,197 A 11/1999 Nelson et al.
5,993,329 A 11/1999 Shieh
6,050,904 A 4/2000 Kuo
6,071,200 A 6/2000 Song
6,162,133 A 12/2000 Peterson
6,165,081 A 12/2000 Chou
6,193,614 B1 2/2001 Sasamoto et al.
6,248,024 B1 6/2001 Nelson et al.
6,248,025 B1 6/2001 Murphy et al.
6,299,547 B1 10/2001 Kosmatka
6,338,683 B1 1/2002 Kosmatka
6,354,962 B1 3/2002 Galloway et al.
6,364,789 B1 4/2002 Kosmatka
6,368,234 B1 4/2002 Galloway
6,390,932 B1 5/2002 Kosmatka et al.
6,406,378 B1 6/2002 Murphy et al.
6,406,381 B2 6/2002 Murphy et al.
6,435,980 B1 8/2002 Reyes et al.
6,440,008 B2 8/2002 Murphy et al.
6,440,011 B1 8/2002 Hocknell et al.
6,582,323 B2 6/2003 Soracco et al.
6,607,451 B2 8/2003 Kosmatka et al.
6,648,774 B1 11/2003 Lee
6,669,576 B1 12/2003 Rice
6,669,577 B1 12/2003 Hocknell et al.
6,743,117 B2 6/2004 Gilbert
6,835,144 B2 12/2004 Best
6,918,840 B2 7/2005 Stites et al.
6,921,343 B2 7/2005 Solheim
6,921,344 B2 7/2005 Gilbert et al.
6,923,732 B2 8/2005 Stites et al.
6,991,559 B2 1/2006 Yabu
7,004,852 B2 2/2006 Billings
7,140,974 B2 11/2006 Chao et al.
7,147,571 B2 12/2006 Best et al.
7,189,165 B2 3/2007 Yamamoto
7,207,899 B2 4/2007 Imamoto
7,232,377 B2 6/2007 Gilbert et al.
7,267,620 B2 * 9/2007 Chao et al. ..... 473/342
7,300,361 B2 11/2007 Stites et al.
7,303,486 B2 12/2007 Imamoto
7,316,623 B2 1/2008 Imamoto
7,357,730 B2 4/2008 Shieh
7,476,162 B2 1/2009 Stites et al.
7,481,719 B2 1/2009 Imamoto
7,628,712 B2 * 12/2009 Chao et al. ..... 473/342
2001/0055995 A1 12/2001 Cackett et al.
2002/0065146 A1 5/2002 Kusumoto
2002/0169034 A1 11/2002 Hocknell et al.
2003/0036442 A1 2/2003 Chao et al.
2003/0139227 A1 7/2003 Sugimoto
2005/0026718 A1 2/2005 Chen
2005/0075191 A1 4/2005 Bennett
2007/0049417 A1 3/2007 Shear
2007/0129162 A1 6/2007 Pan et al.
2007/0129166 A1 6/2007 Shimazaki et al.
2007/0293349 A1 12/2007 Chao et al.
2008/0004134 A1 1/2008 Roach et al.
2008/0032813 A1 2/2008 Hagood et al.
2008/0032815 A1 2/2008 Yamamoto
2008/0058117 A1 3/2008 Roach

FOREIGN PATENT DOCUMENTS

GB 2 338 903 1/2000
JP 60-15145 1/1985
JP 01-171583 A 7/1989
JP 4109973 4/1992
JP 05-007261 2/1993
JP U-H05-068564 9/1993
JP 6-23071 2/1994
JP 6079023 3/1994
JP 6503490 4/1994
JP 06-165842 6/1994
JP 6-205858 7/1994
JP 07-001958 1/1995
JP 9117537 5/1997
JP 09-176347 7/1997
JP 09-299519 11/1997
JP 10-155943 6/1998
JP 11-137734 5/1999
JP 11-347155 12/1999
JP 2001-293112 10/2001
JP 2001316971 11/2001
JP 2002315854 10/2002
JP 2002-331051 11/2002

| | | |
|---|---|---|
| JP | 2003-024483 | 1/2003 |
| JP | 2003-144590 | 5/2003 |
| JP | 2003138041 | 5/2003 |
| JP | T-2003-518993 | 6/2003 |
| JP | 2005-218510 | 8/2005 |
| JP | 2006-167033 | 6/2006 |
| WO | WO2006/017605 | 2/2006 |

OTHER PUBLICATIONS

Taylor Made '94/'95 Products—Mid Tour; Mid Tour GF.

Japanese Office action (English translation), Japanese App. No. 2005-123040, filed Apr. 21, 2005, 3pp. (Aug. 3, 2010).

* cited by examiner

GOLF CLUB HEAD HAVING A COMPOSITE FACE INSERT

CROSS REFERENCE TO RELATED APPLICATION

This application is a divisional of U.S. patent application Ser. No. 11/895,195, filed Aug. 21, 2007, now U.S. Pat.No.7,628,712,which is a continuation of U.S. patent application Ser. No. 10/442,348, filed May 21, 2003 (now U.S. Pat. No. 7,267,620), which are hereby incorporated herein by reference.

BACKGROUND

The present invention relates generally to golf club heads and, more particularly, to a wood-type golf club head having a composite face insert.

Composite materials have long been recognized for combining many beneficial attributes of various types and are commonly used in golf club heads. Composite materials typically are less dense than other materials used in golf clubs. Thus, the use of composite materials allows for more leeway in how weight is distributed about the club. It is often desirable to locate club weight away from the striking face. Thus, attempts have been made to incorporate composite materials in the club face.

Although such attempts have been generally effective for weight reduction purposes, a number of shortfalls remain, such as durability, impact resistance and overall club performance. For example, prior composite club faces have often suffered from delamination, or peeling apart, of composite layers, greatly reducing the useable life of the club. Delamination is particularly a problem at interface regions between the composite material and other materials of the club head. Such problems have arisen even at relatively low impact levels, hit counts and in benign playing conditions. Attempts to resolve such problems often fail to provide satisfactory club performance, measured by factors such as coefficient of restitution (COR), particularly for wood-type club heads having a volume of at least 300 cc. It should, therefore, be appreciated that there exists a need for a wood-type golf club head having composite material at the club face that is durable, can endure high level impacts and yet provide superior club performance. The present invention fulfills this need and others.

It should, therefore, be appreciated that there exists a need for a wood-type golf club head having composite material at the club face that is durable, can endure high level impacts and yet provide superior club performance. The present invention fulfills this need and others.

SUMMARY

The invention provides a golf club head having a lightweight face insert attached to a body that is at least partly formed of a metallic material, providing superior durability and club performance. To that end, the face insert comprises prepreg plies having a fiber areal weight (FAW) of less than 100 g/m$^2$. The body preferably forms a volume of at least 200 cc. The face insert preferably has a thickness less than 4 mm and has a mass at least 10 grams less than an insert of equivalent volume formed of the metallic material of the body of the club head. The coefficient of restitution for the club head, measured in accordance to the United States Golf Association Rule 4-1a, is at least 0.79.

In a preferred embodiment of the invention, the face insert further includes a cap with a peripheral rim that is attached to a front surface of the composite region. Also preferably, the thickness of the composite region is about 4.5 mm or less and the metallic cap thickness is about 0.5 mm or less; more preferably the thickness of the composite region is about 3.5 mm or less and the metallic cap thickness is about 0.3 mm or less. The cap preferably comprises a titanium alloy. The face insert may alternatively comprise a layer of textured film co-cured with the plies of low FAW material, in which the layer of textured film forms a front surface of the face insert instead of the metallic cap. The layer of textured film preferably comprises nylon fabric. Without the metallic cap, the mass of the face insert is at least 15 grams less than an insert of equivalent volume formed of the metallic material of the body of the club head.

A preferred method of the present invention advantageously controls the resin content of the low fiber areal weight (FAW) composite material of the golf club face. The steps comprise:

- stacking and cutting a plurality of prepreg plies having a fiber areal weight (FAW) of less than 100 g/m$^2$ to form an uncured face insert having substantially a final desired shape, bulge and roll;
- placing the uncured face insert into a tool with an initial temperature $T_1$;
- curing the uncured face insert for about 5 minutes at a first pressure $P_1$ then initiating heating the tool to a set temperature $T_2$ greater than or equal to the initial temperature $T_1$ and curing another 15 minutes at a second pressure $P_2$ greater than the first pressure $P_1$, thus obtaining the cured face insert;
- continue forming the cured face insert at the set temperature and second pressure $P_2$ for about 30 minutes; and
- soaking the cured face insert for 5 minutes at a third pressure $P_3$ less than the second pressure $P_2$, such that the desired resin content is achieved.

Alternatively, the tool temperature may be immediately raised to a set temperature $T_2$ upon placement of the composite material therein, this temperature being held substantially constant over the soaking and curing phases. After an initial soaking time of about 5 minutes, the pressure is raised from a first pressure $P_1$ to a second pressure $P_2$ greater than the first pressure $P_1$. After an additional time of about 15 minutes, the pressure is reduced to about the same value as the first pressure for about another 20 minutes.

For purposes of summarizing the invention and the advantages achieved over the prior art, certain advantages of the invention have been described above. Of course, it is to be understood that not necessarily all such advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment disclosed.

BRIEF DESCRIPTION OF THE DRAWINGS

Embodiments of the present invention will now be described, by way of example only, with reference to the following drawings in which.

DETAILED DESCRIPTION

Figure 1:
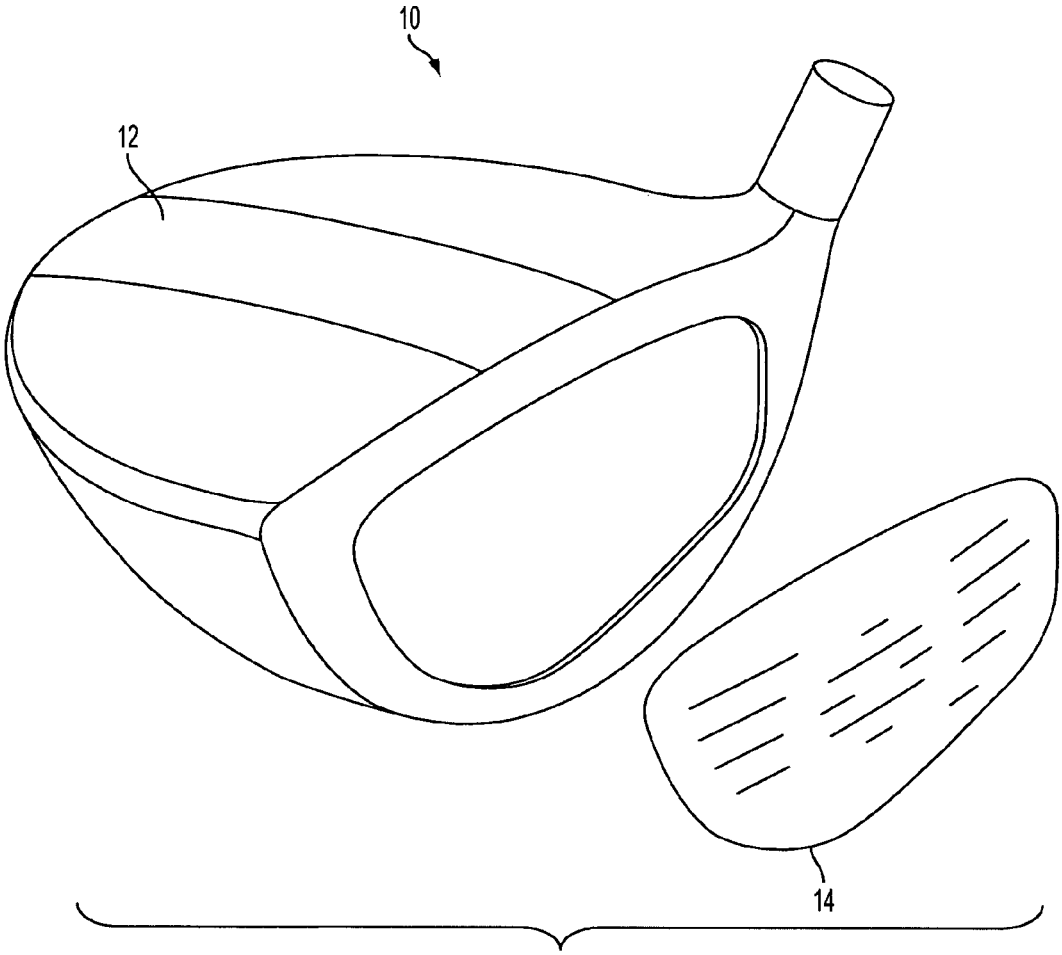
FIG. 1 is an exploded view of a club head in accordance with the invention, depicting a composite face insert and a metallic body.
Figure 2:
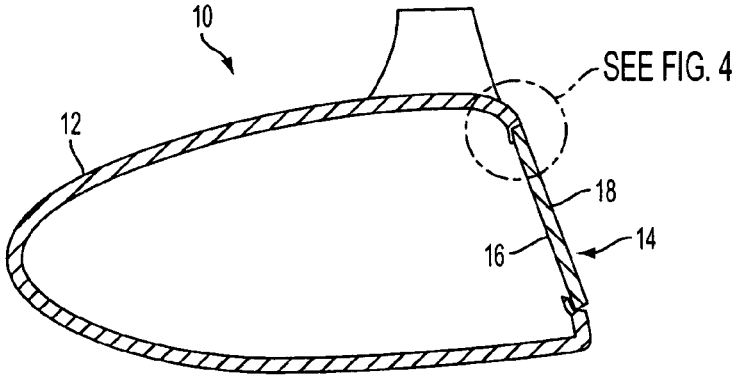
FIG. 2 is a cross-sectional view of the club head of FIG. 1.

With reference to the illustrative drawings, and particularly FIGS. 1 and 2, there is shown a golf club head 10 having a metallic body 12 and a face insert 14 comprising a composite region 16 and a metallic cap 18. The face insert 14 is durable and yet lightweight. As a result, weight can be allocated to other areas of the club head 10, enabling the club head's center of gravity to be desirably located farther from the striking face 40 and to further enhance the club head's moment of inertia. The body 12 includes an annular ledge 32 for supporting the face insert 14. In a preferred embodiment, the body 12 is formed by investment casting a titanium alloy. With the face insert 14 in place, the club head 10 preferably defines a volume of at least 200 cc and more preferably a volume of at least 300 cc. The club head 10 has superior durability and club performance, including a coefficient of restitution (COR) of at least 0.79.

Figure 3:
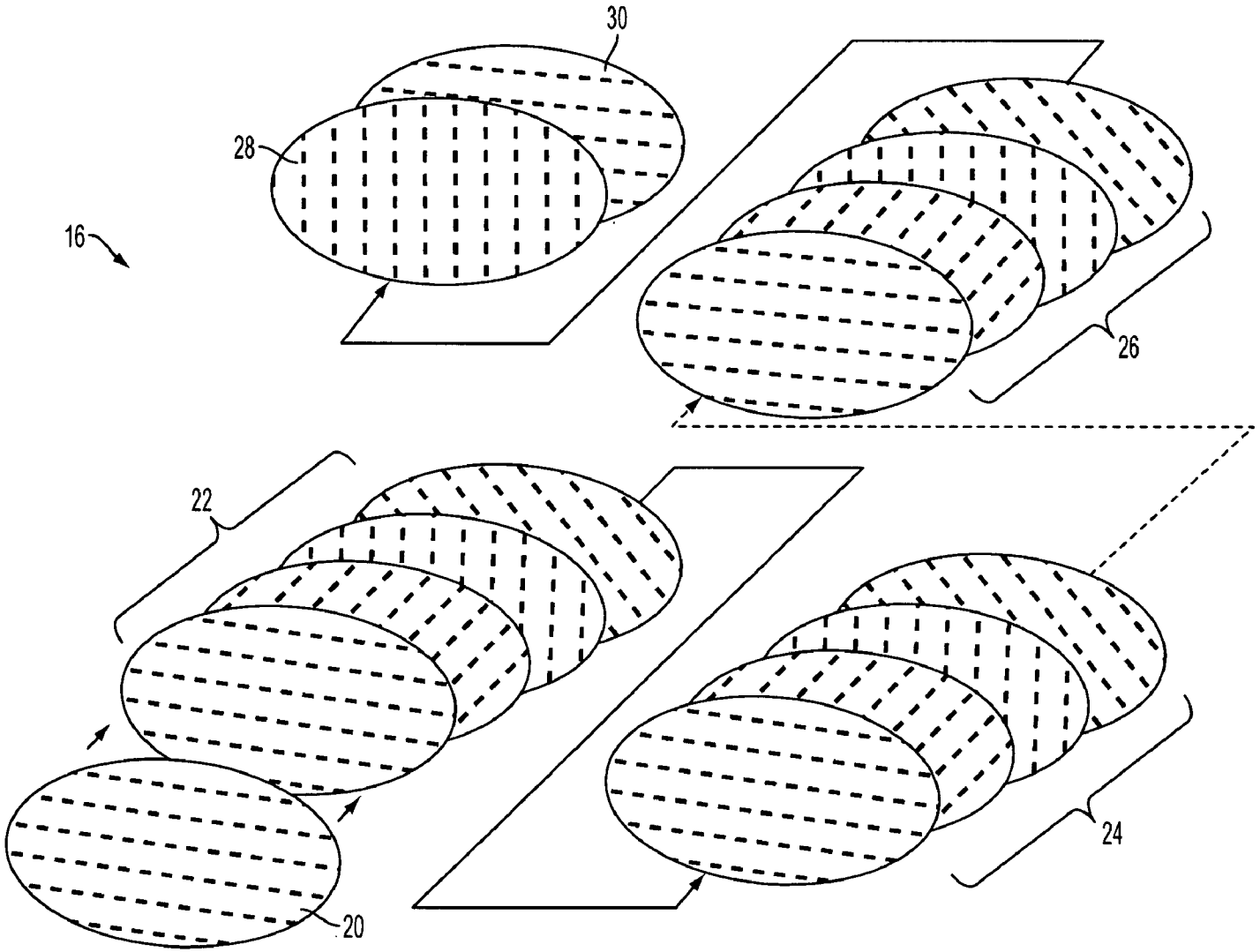
FIG. 3 is an exploded view of the composite region of the face insert of FIG. 1 showing the plies comprising the composite region.

With reference to FIG. 3, the composite region 16 of the face insert 14 is configured to have a relatively consistent distribution of reinforcement fibers across a cross section of its thickness to facilitate efficient distribution of impact forces and overall durability. The composite region 16 includes prepreg plies, each ply having a fiber reinforcement and a resin matrix selected to contribute to the club's durability and overall performance. Tests have demonstrated that composite regions formed of prepreg plies having a relatively low fiber areal weight (FAW) provide superior attributes in several areas, such as, impact resistance, durability and overall club performance. More particularly, FAW values below 100 $g/m^2$, or preferably 70 $g/m^2$ or more preferably 50 $g/m^2$, are considered to be particularly effective. Several prepreg plies having a low FAW can be stacked and still have a relatively uniform distribution of fiber across the thickness of the stacked plies. In contrast, at comparable resin content (R/C) levels, stacked plies of prepreg materials having a higher FAW tend to have more significant resin rich regions, particularly at the interfaces of adjacent plies, than stacked plies of lower FAW materials. It is believed that resin rich regions tend to inhibit the efficacy of the fiber reinforcement, particularly since the force resulting from golf ball impact is generally transverse to the orientation of the fibers of the fiber reinforcement. Preferred methods of manufacturing, which aid in reducing resin rich regions, are discussed in detail further below.

Due to the efficiency of prepreg plies of low FAW, the face insert 14 can be relatively thin, preferably less than about 4.5 mm and more preferably less than about 3.5 mm. Thus, use of the face insert 14 results in weight savings of about 10 g to 15 g over a comparable volume of metal used in the body 12 (e.g., Ti-6Al-4V). As mentioned above, this weight can be allocated to other areas of the club, as desired. Moreover, the club head 10 has demonstrated both superior durability and performance. In a durability test, the club head 10 survived over 3000 impacts of a golf ball shot at a velocity of about 44 m/sec. In a performance test of the club's COR, measured in accordance with the United States Golf Association Rule 4-1a, the club head had a COR of about 0.828.

With continued reference to FIG. 3, each prepreg ply of the composite region 16 preferably has a quasi-isotropic fiber reinforcement, and the plies are stacked in a prescribed order and orientation. For convenience of reference, the orientation of the plies is measured from a horizontal axis of the club head's face plane to a line aligned with the fiber orientation of each ply. A first ply 20 of the composite region 16 is oriented at 0 degrees, followed by ten to twelve groups of plies (22, 24, 26) each having four plies oriented at 0, +45, 90 and −45 degrees, respectively. Thereafter, a ply 28 oriented at 90 degrees precedes the final or innermost ply 30 oriented at 0 degrees. In this embodiment, the first and final plies are formed of a prepreg material reinforced by glass fibers, such as 1080 glass fibers. The remaining plies are formed of prepreg material reinforced by carbon fiber.

A suitable carbon fiber reinforcement comprises a carbon fiber known as "34-700" fiber, available from Grafil, Inc., of Sacramento, Calif., which has a tensile modulus of 234 Gpa (34 Msi) and tensile strength of 4500 Mpa (650 Ksi). Another suitable fiber, also available from Grafil, Inc., is a carbon fiber known as "TR50S" fiber which has a tensile modulus of 240 Gpa (35 Msi) and tensile strength of 4900 Mpa (710 Ksi). Suitable epoxy resins known as Newport 301 and 350 are available from Newport Adhesives & Composites, Inc., of Irvine, Calif.

In a preferred embodiment, the composite region 16 includes prepreg sheets having a quasi-isotropic fiber reinforcement of 34-700 fiber having an areal weight of about 70 $g/m^2$ and impregnated with an epoxy resin (e.g., Newport 301) resulting in a resin content (R/C) of about 40%. For convenience of reference, the primary composition of a prepreg sheet can be specified in abbreviated form by identifying its fiber areal weight, type of fiber, e.g., 70 FAW 34-700. The abbreviated form can further identify the resin system and resin content, e.g., 70 FAW 34-700/301, R/C 40%. In a durability test, several plies of this material were configured in a composite region 16 having a thickness of about 3.7 mm. The resulting composite region 16 survived over 3000 impacts of a golf ball shot at a velocity of about 44 m/sec. In another preferred embodiment, the composite region 16 comprises prepreg plies of 50 FAW TR50S/350. This material was tested in a composite region 16 having a thickness of about 3.7 mm and it too survived a similar durability test.

Figure 4:
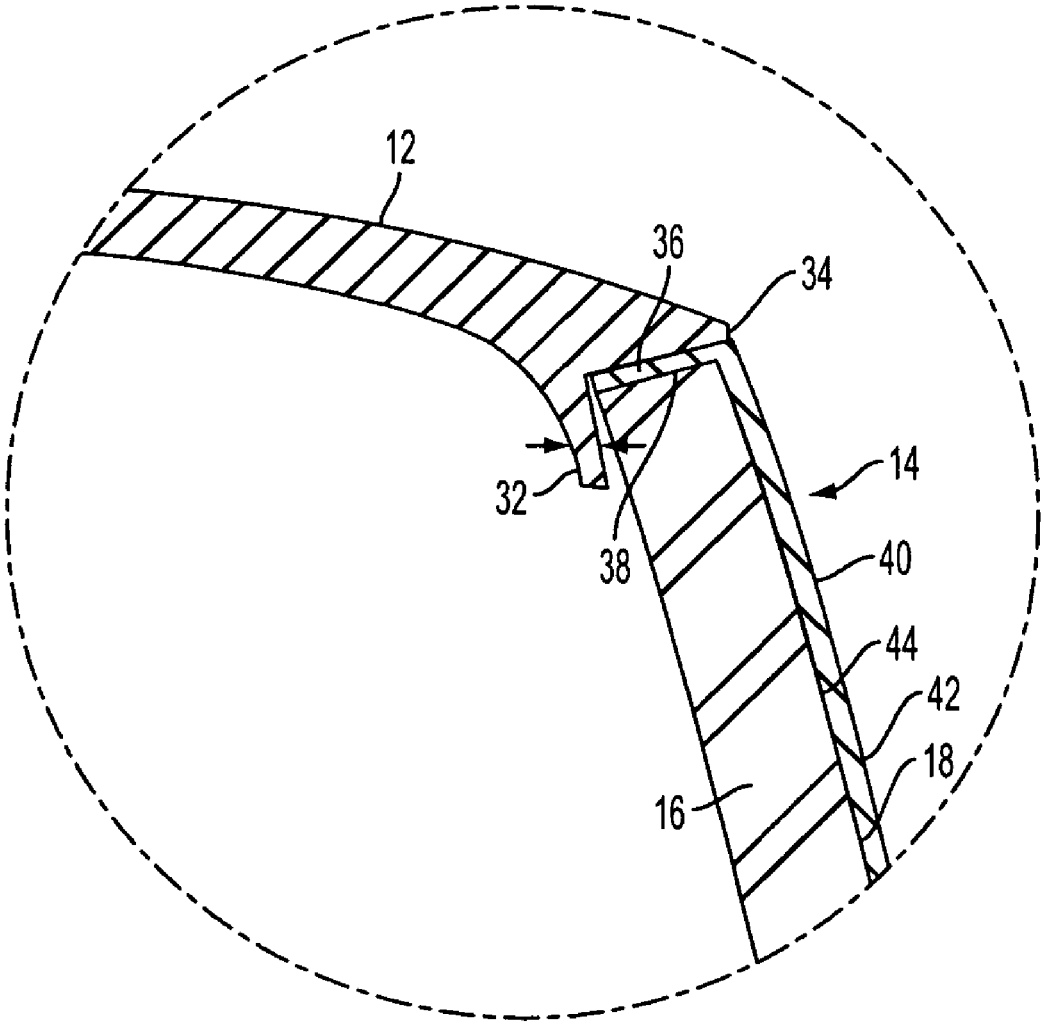
FIG. 4 is a close-up view of area A-A of the club head of FIG. 2, depicting a junction of the composite face insert and the body portion.

With reference to FIG. 4, the face insert 14 has sufficient structural strength that excessive reinforcement along the interface of the body 12 and the face insert 14 is not required, which further enhances beneficial weight allocation effects. In this embodiment, the body 12 is formed of a titanium alloy, Ti-6Al-4V; however, other suitable material can be used. The face insert 14 is supported by an annular ledge 32 and is secured preferably with an adhesive. The annular ledge 32 preferably has a thickness of about 1.5 mm and extends inwardly between about 3 mm to about 6 mm. The annular ledge 32 is sufficiently recessed to allow the face insert 14 to sit generally flush with a transition edge 34 of the body. Although, in this embodiment, the annular ledge 32 extends around the periphery of the front opening, it will be appreciated that other embodiments can utilize a plurality of spaced annular ledges, e.g., a plurality of tabs, to support the face insert 14.

With continued reference to FIG. 4, the metallic cap 18 of the face insert 14 includes a rim 36 about the periphery of the composite region 16. In a preferred embodiment, the metallic cap 18 may be attached to a front surface of the face insert 14, wherein the combined thickness of the prepreg plies of the face insert 14 and the metallic cap 18 are no greater than the depth D of the annular ledge 32 at the front opening of the body 12. The rim 36 covers a side edge 38 of the composite region 16 to further protect against peeling and delamination of the plies. Preferably, the rim 36 has a height substantially the same as the thickness of the face insert 14. In an alternative embodiment, the rim 36 may comprise a series of segments instead of a continuous cover over the side edge 38 of the composite region 16. The metallic cap 18 and rim 36 may be formed, for example, by stamping or other methods known to those skilled in the art. A preferred thickness of the metallic cap 18 is less than about 0.5 mm, and more preferably, it is less than about 0.3 mm. However, in embodiments having a face insert 14 without a metallic cap 18, weight savings of about 15 g can be realized.

Preferably, the thickness of the composite region 16 is about 4.5 mm or less and the thickness of the metallic cap 18 is about 0.5 mm or less. More preferably the thickness of the composite region 16 is about 3.5 mm or less and the thickness of the metallic cap 18 is about 0.3 mm or less. The metallic cap preferably comprises a titanium alloy.

Composite Material Process

The metallic cap 18 defines a striking face 40 having a plurality of grooves 42. The metallic cap 18 further aids in resisting wear from repeated impacts with golf balls even when covered with sand. Preferably, a bond gap 44 of about 0.05 mm to 0.2 mm, and more preferably about 0.1 mm, is provided for adhesive attachment of the metallic cap 18 to the composite region 16. In an alternative embodiment, the bond gap 44 may be no greater than 0.2 mm. The metallic cap 18 is preferably formed of Ti-6Al-4V titanium alloy; however, other titanium alloys or other materials having suitable characteristics can be employed. For example, a non-metallic cap, such as a cap comprising injection-molded plastic, having a density less than 5 g/cc and a hardness value of 80 Shore D may be employed.

As mentioned above, it is beneficial to have a composite region 16 that is relatively free of resin rich regions. To that end, fiber reinforcement sheets are impregnated with a controlled amount of resin to achieve a prescribed resin content. This is realized, in part, through management of the timing and environment in which the fiber sheets are cured and soaked.

The plies can be cut at least twice before achieving the desired dimensions. A preferred approach includes cutting plies to a first size, debulking the plies in two compression steps of about two minutes each. Thereafter, the plies are die cut to the desired shape, and compressed a third time; this time using a panel conformed to the desired bulge and roll. The plies are then stacked to a final thickness and compressed a fourth time with the conformed panel for about three minutes. The weight and thickness are measured preferably prior to the curing step.

The plies can be cut at least twice before achieving the desired dimensions. A preferred approach includes cutting plies to a first size and debulking the plies in two compression steps of about two minutes each. Thereafter, the plies are die cut to the desired shape, and compressed a third time using a panel conformed to the desired bulge and roll. The plies are then stacked to a final thickness and compressed a fourth time with the conformed panel for about three minutes. The weight and thickness of the plies are measured preferably prior to the curing step.

Figure 5:
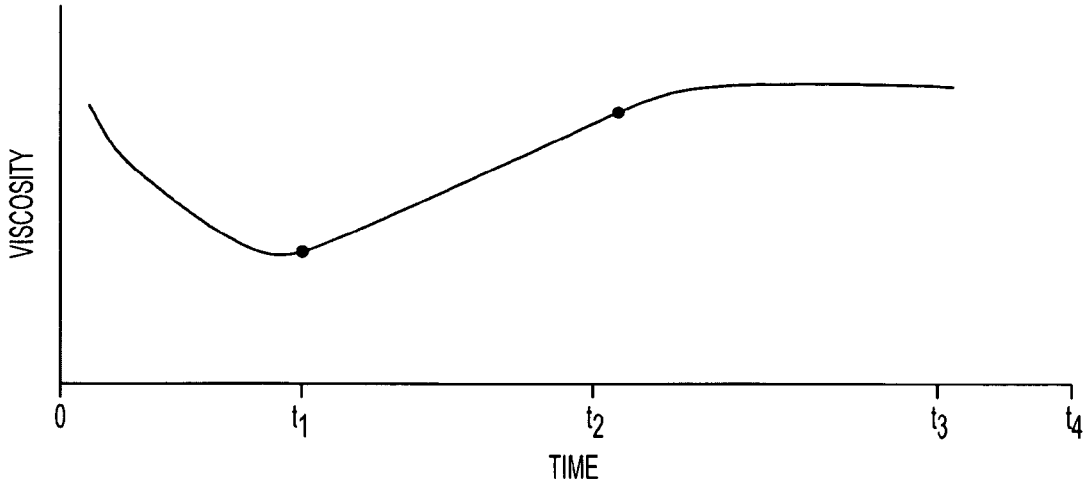
FIG. 5 is a graph depicting resin viscosity over time during the soaking and curing phases for a preferred method of forming the composite portion of the face insert of FIG. 1.
Figure 6:
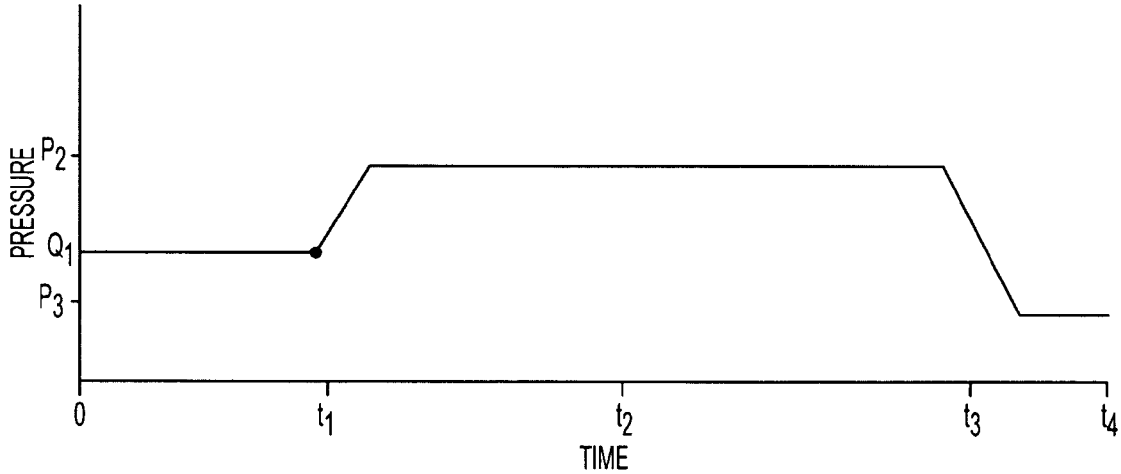
FIG. 6 is a graph depicting pressure over time during the soaking and curing phases of forming the composite portion of the face insert, corresponding to FIG. 5.
Figure 7:
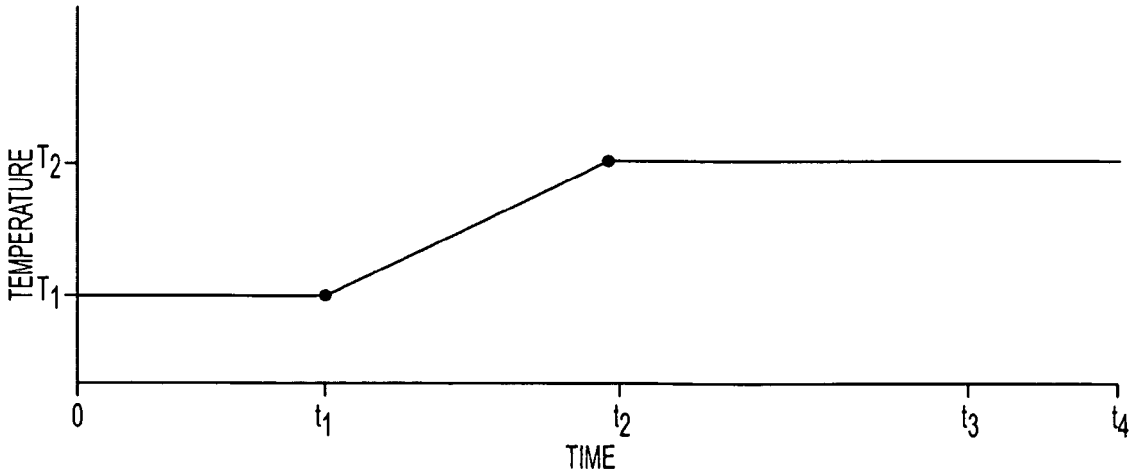
FIG. 7 is a graph depicting temperature over time during the soaking and curing phases of forming the composite portion of the insert, corresponding to FIG. 5.

FIGS. 5-7 depict an effective soaking and curing profile for impregnating plies 70 FAW 34/700 fiber sheet with Newport 301 resin. Soaking and curing occurs in a tool having upper and lower plates. The tool is pre-layered with a mold release to facilitate removal of the composite material and is preheated to an initial temperature ($T_1$) of about 200° F. The initial soak period is for about 5 minutes, from $t_0$ to $t_1$. During the soak phase, the temperature and pressure remain relatively constant. The pressure ($P_1$) is at about 15 psi.

Figure 8:
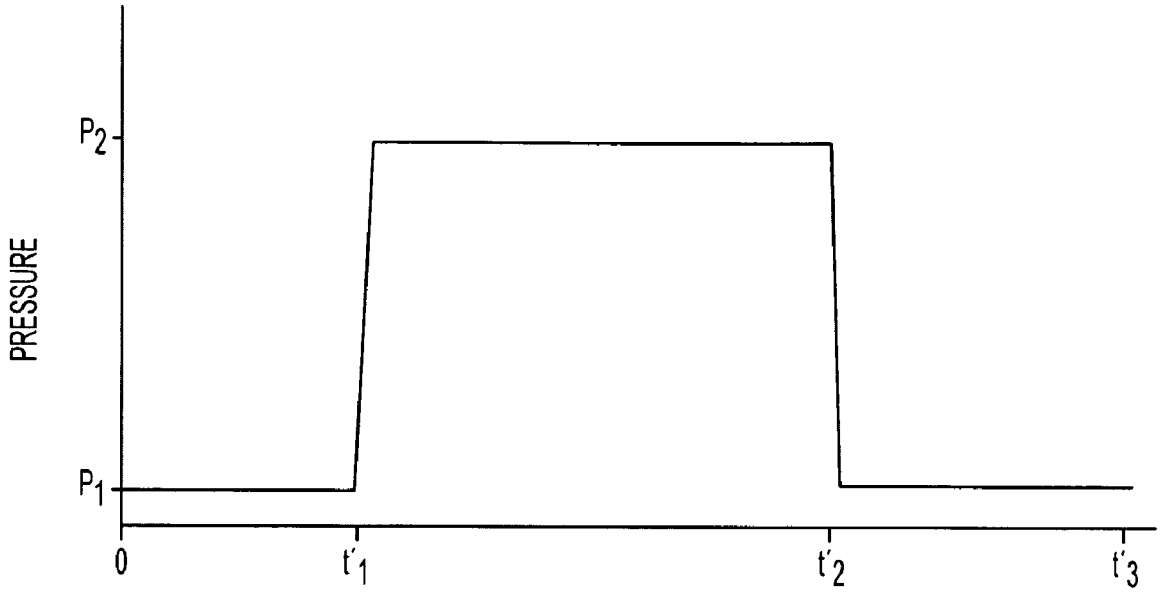
FIG. 8 is a graph depicting pressure over time during the soaking and curing phases of an alternative method of forming the composite portion of the insert of FIG. 1.
Figure 9:
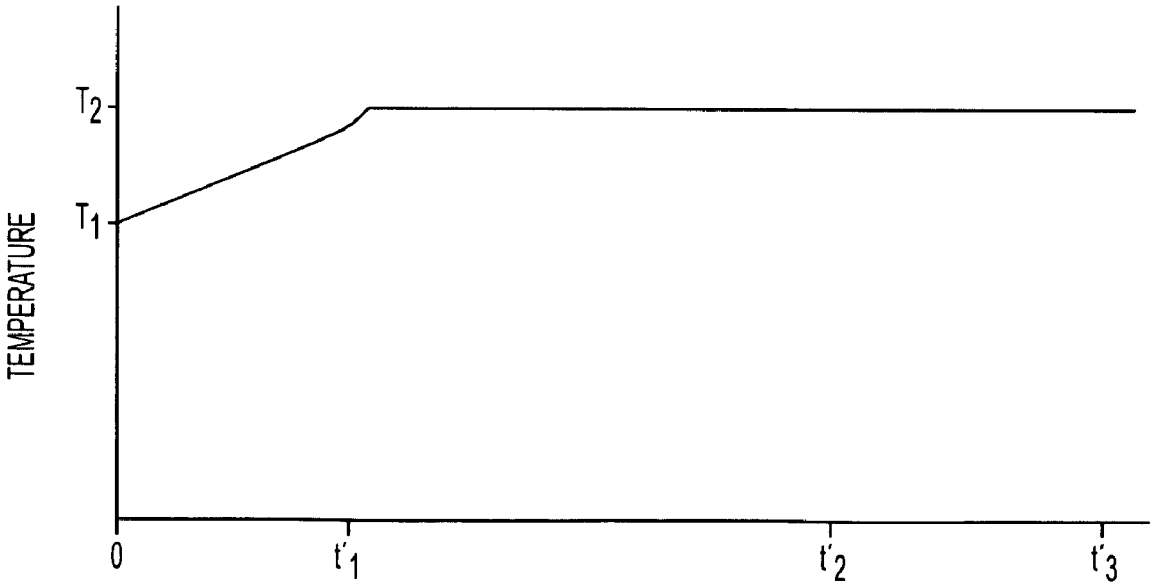
FIG. 9 is a graph depicting temperature over time during the soaking and curing phases of forming the composite portion of the insert, corresponding to FIG. 8.

An alternative soaking and curing profile is depicted in FIGS. 8 and 9. In this process, the temperature of the tool is initially about 200° F. ($T_1$) and upon placement of the composite material into the tool, the temperature is increased to about 270° F. ($T_2$). The temperature is then kept constant. The initial pressure ($P_1$) is about 20 psi. The initial soak period is for about 5 minutes, from $t_0$ (0 sec.) to $t'_1$. The pressure is then ramped up to about 200 psi ($P_2$). The post cure phase lasts about 15 minutes ($t'_1$ to $t'_2$) and a final soaking/curing cycle is performed at a pressure ($P_1$) of 20 psi for 20 minutes ($t'_2$ to $t'_3$).

Composite Face Roughness Treatment

In order to increase the surface roughness of the composite golf club face and to enhance bonding of adhesives used therewith, a layer of textured film can be placed on the material before curing. An example of the textured film is ordinary nylon fabric. Curing conditions do not degrade the fabric and an imprint of the fabric texture is transferred to the composite surface. Tests have shown that adhesion of urethane and epoxy, such as 3M® DP460, to the treated composite surface was greatly improved and superior to adhesion to a metallic surface, such as cast titanium alloy.

In order to increase the surface roughness of the composite region 16 and to enhance bonding of adhesives used therewith, a layer of textured film can be placed on the composite material before curing. An example of the textured film is ordinary nylon fabric. Curing conditions do not degrade the fabric and an imprint of the fabric texture is transferred to the composite surface. Tests have shown that adhesion of urethane and epoxy, such as 3M® DP460, to a composite surface treated in such a fashion was greatly improved and superior to adhesion to a metallic surface, such as cast titanium alloy.

A face insert 14 having increased surface roughness may comprise a layer of textured film co-cured with the plies of low FAW material, in which the layer of textured film forms a front surface of the face insert 14 instead of the metallic cap 18. The layer of textured film preferably comprises nylon fabric. Without the metallic cap 18, the mass of the face insert 14 is at least 15 grams less than a face insert of equivalent volume formed of the metallic material of the body 12 of the club head 10.

Typically, adhesion of the 3M® DP460 adhesive to a cast metallic surface is greater than to an untreated composite surface. Consequently, when the face structure fails on impact, the adhesive peels off the composite surface but remains bonded to the metallic surface. After treating a composite surface as described above, the situation is reversed [–] and the 3M® DP460 peels off the metallic surface but remains bonded to the composite surface.

The enhanced adhesion properties of this treatment contribute to an improved fatigue life for a composite golf club face. In a test, a club head having an untreated face insert 14 and a COR of about 0.847 endured about 250 test shots before significant degradation or failure occurred. In contrast, a similar club head having a treated face insert 14 and a COR of about 0.842 endured over 2000 shots before significant degradation or failure occurred.

Alternatively, the means for applying the composite texture improvement may be incorporated into the mold surface. By doing so, the textured area can be more precisely controlled. For simple face plate joining to the opening of a cast body, the texture can be formed in surfaces where shear and peel are the dominant modes of failure.

It should be appreciated from the foregoing that the present invention provides a club head 10 having a composite face insert 14 attached to a metallic body 12, forming a volume of at least 200 cc and providing superior durability and club performance. To that end, the face insert 14 comprises prepreg plies having a fiber areal weight (FAW) of less than 100 g/m$^2$. The face insert 14 preferably has a thickness less than 5 mm and has a mass at least 10 grams less than a face insert of equivalent volume formed of the metallic material of the body 12 of the club head 10. The coefficient of restitution for the club head 10 is preferably at least 0.79.

Alternatively, the face insert 14 may comprise any non-metallic material having a density less than a metallic material of the body 12 along with a metallic cap 18 covering a front surface of the face insert 14 and having a rim 36. For example, the face insert 14 of the present invention may comprise a composite material, such as a fiber-reinforced plastic or a chopped-fiber compound (e.g., bulk molded compound or sheet molded compound), or an injection-molded polymer either alone or in combination with prepreg plies having low FAW. The thickness of the face insert 14 may be substantially constant or it may comprise a variation of at least two thicknesses, one being measured at a geometric center and another measured near a periphery of the face insert 14. In one embodiment, for example, an injection-molded polymer disk may be embedded in a central region of a plurality of low FAW prepreg plies. The total thickness of the face insert 14 may range between about 1 mm and about 8 mm, and preferably between about 2 mm and about 7 mm, more preferably between about 2.5 mm and about 4 mm, and most preferably between about 3 mm and about 4 mm.

In addition, the body 12 of a club head 10 in the present invention may be formed of a metallic material, a non-metallic material or a combination of materials, such as a steel skirt and sole with a composite crown, for example. Also, one or more weights may be located in or on the body 12, as desired, to achieve final performance characteristics for the club head 10.

We claim:

1. A golf club head having a volume of at least 300 cc, comprising:

a body having a crown, a skirt, and a sole, the body defining a transition edge and a front opening;

a face insert having at least a portion comprising prepreg plies having a fiber areal weight, the face insert closing the front opening of the body;

a metallic cap adhesively attached to the prepreg plies wherein the prepreg plies are configured to reinforce a majority of a metallic cap striking surface, the metallic cap abutting the transition edge to form a substantially flush golf club head front surface;

wherein the face insert's total thickness is within a range of about 3.0 mm to about 4.5 mm, the golf club head having a coefficient of restitution of at least 0.79; and the prepreg plies including carbon fiber reinforcement having a fiber areal weight of less than 100 g/m$^2$;

2. A golf club head having a volume of at least 300 cc, comprising:

a body having a crown, a skirt and a sole, the body defining a transition edge and a front opening;

a face insert comprising prepreg plies having a fiber areal weight, the face insert attached at and closing the front opening of the body;

a metallic cap attached to the prepreg plies wherein the prepreg plies are configured to reinforce a majority of a metallic cap striking surface, the metallic cap abutting the transition edge to form a substantially flush golf club head front surface;

wherein the thickness of the prepreg plies is about 4.5 mm or less, and the thickness of the metallic cap is about 0.5 mm or less, and wherein the golf club head has a coefficient of restitution of at least 0.79, and wherein the metallic cap is formed with a density less than 5 g/cc. the cap covering a front surface of the prepreg plies and comprising a peripheral rim;

wherein the prepreg plies have a fiber areal weight of less than 100 g/m$^2$.

3. The golf club head of claim 2, wherein the prepreg plies have a fiber areal weight of less than 70 g/m$^2$.

4. A golf club head having a volume of at least 300cc, comprising:

a body having a crown, a skirt and a sole, the body defining a front opening;

a face insert comprising prepreg plies having a resin content of about 40%, the face insert attached at and closing the front opening of the body;

wherein the thickness of the prepreg plies is about 4.5 mm or less and the prepreg plies are configured to reinforce a majority of a cap striking surface, and wherein the golf club head has a coefficient of restitution of at least 0.79, wherein the body comprises an annular ledge extending around the periphery of the front opening, and wherein the face insert is coupled to the annular ledge; and wherein the prepreg plies have a fiber areal weight of less than 100 g/m$^2$.

5. A golf club head having a volume of at least 300 cc, comprising:

a body having a crown, a skirt and a sole, the body defining a front opening;

a face insert comprising a plurality of stacked groups of 10 or more prepreg plies and the prepreg plies are configured to reinforce a majority of a cap striking surface, wherein each group of plies is arranged at a different orientation with respect to an adjacent group of plies, the face insert attached at and closing the front opening of the body;

wherein the thickness of the prepreg plies is about 4.5 mm or less, and wherein the golf club head has a coefficient of restitution of at least 0.79, wherein the body comprises an annular ledge extending around the periphery of the front opening, and wherein the face insert is coupled to the annular ledge; and wherein the prepreg plies have a fiber areal weight of less than 100 g/m$^2$.

* * * * *